US012144427B2

(12) United States Patent
Palmer

(10) Patent No.: US 12,144,427 B2
(45) Date of Patent: Nov. 19, 2024

(54) CONVERTER TO MAKE STATIONARY FURNITURE SLIDABLE OR RECIPROCATING

(71) Applicant: David Palmer, Houston, TX (US)

(72) Inventor: David Palmer, Houston, TX (US)

( * ) Notice: Subject to any disclaimer, the term of this patent is extended or adjusted under 35 U.S.C. 154(b) by 853 days.

(21) Appl. No.: 17/327,212

(22) Filed: May 21, 2021

(65) Prior Publication Data

US 2021/0361074 A1 Nov. 25, 2021

Related U.S. Application Data

(60) Provisional application No. 63/027,997, filed on May 21, 2020.

(51) Int. Cl.
*A47C 21/00* (2006.01)
*A47B 91/04* (2006.01)

(52) U.S. Cl.
CPC ..... *A47C 21/006* (2013.01); *A47B 91/04* (2013.01)

(58) Field of Classification Search
CPC ..... A47B 91/04
See application file for complete search history.

(56) References Cited

U.S. PATENT DOCUMENTS 77,161 A * 4/1868 Blake ..... A47C 7/002 248/188.9
92,758 A * 7/1869 Smith ..... A47B 91/04 5/104
490,366 A * 1/1893 Seng ..... E04G 25/06 5/104
1,396,661 A * 11/1921 Parr ..... A47C 7/002 248/188.9
2,056,957 A * 10/1936 Colbridge ..... A47B 91/04 248/188.9
2,244,614 A * 6/1941 Fox ..... A47C 3/027 297/267.1
3,427,019 A * 2/1969 Brown ..... A63H 11/06 482/77
3,938,857 A * 2/1976 Craig ..... A47C 3/027 297/267.1
5,490,715 A * 2/1996 Opsvik ..... A47C 3/02 297/310
6,682,495 B2 * 1/2004 Park ..... A47C 21/006 601/84
7,744,049 B2 * 6/2010 Kwon ..... A47B 91/16 312/351.3
10,537,732 B2 * 1/2020 Nachum ..... A61N 1/36003
11,534,000 B2 * 12/2022 Cook ..... A47C 7/002
11,805,907 B2 * 11/2023 Penn ..... A47C 1/03272
(Continued)

*Primary Examiner* — LaToya M Louis
(74) *Attorney, Agent, or Firm* — Eric P. Mirabel JD LLM

(57) ABSTRACT

The invention relates to a slide mechanism which can be attached to and support chair, couch or bed legs, one device per leg, to make furniture slidable. The chair, couch or bed leg fits an upward-facing leg holder for one furniture leg. The leg holder is affixed to or part of an upper base having two longitudinal grooves, wherein two screws, one extending into each of the grooves, hold the upper base to a lower base. The two screws are loose enough with respect to the upper side of the upper base to allow the upper base (carrying the leg-holder and the attached furniture leg) to slide relative to the lower base. An elastic member connects the upper base to the lower base.

17 Claims, 3 Drawing Sheets

(56) References Cited

U.S. PATENT DOCUMENTS

| | | | | |
|---|---|---|---|---|
| 2014/0097647 | A1* | 4/2014 | Grace | A47C 3/0255<br>297/42 |
| 2018/0296831 | A1* | 10/2018 | Matsushita | A61N 1/3603 |

* cited by examiner

CONVERTER TO MAKE STATIONARY FURNITURE SLIDABLE OR RECIPROCATING

BACKGROUND

A chair, couch or bed which reciprocates can enhance use for relaxation. In a conventional rocking chair the vertical component of the motion can lead to spilling food or drinks—if the user is holding or resting drinks or plates of food while in the chair. Reciprocating a couch or bed may help sleep or relaxation as well.

For the modern office, it is advantageous to have one's chair out from under a work-station or desk when sitting down, then able to easily slide under the work-station or desk and into position where the user is in an appropriate position to use the equipment on the work-station or desk. It is inconvenient and potentially destructive of flooring to have to pick up and move the chair—especially where the chair position is adjusted after the user is seated. A convenient to install and low-cost solution to make a work chair slidable, and/or to make relaxation furniture reciprocate in one plane, is clearly desirable.

SUMMARY

The invention relates to a slide mechanism which can be attached to and support chair, couch or bed legs, one device per leg, to make furniture slidable. The chair, couch or bed leg fits an upward-facing leg holder for one furniture leg. The leg holder is affixed to or part of an upper base having two longitudinal grooves, wherein two screws, one extending into each of the grooves, hold the upper base to a lower base. The two screws are loose enough with respect to the upper side of the upper base to allow the upper base (carrying the leg-holder and the attached furniture leg) to slide relative to the lower base.

Preferably, the upper base can pivot laterally about the two screws, to at least some degree. For use with an office chair, the lateral pivoting is preferably enough to allow the chair to turn sideways and allow easier access and egress for the user when the chair is under a desk, work station or table.

A spring or other elastic member is tensioned to assist in pulling upper base (carrying the leg-holder and the attached chair leg) back into the original position. For relaxation furniture, the tension is preferably strong enough to pull the furniture back with the user in place. For use of the device with an office chair, the spring tension is less, and does not return to the original position until the user arises and lifts his/her weight off the chair. The chair is then positioned for the user to sit again (or lie down again, if the furniture is a couch or bed) and then do the work from the seated or prone position to again slide the furniture legs with respect to the lower bases.

DETAILED DESCRIPTION

Figure 1:
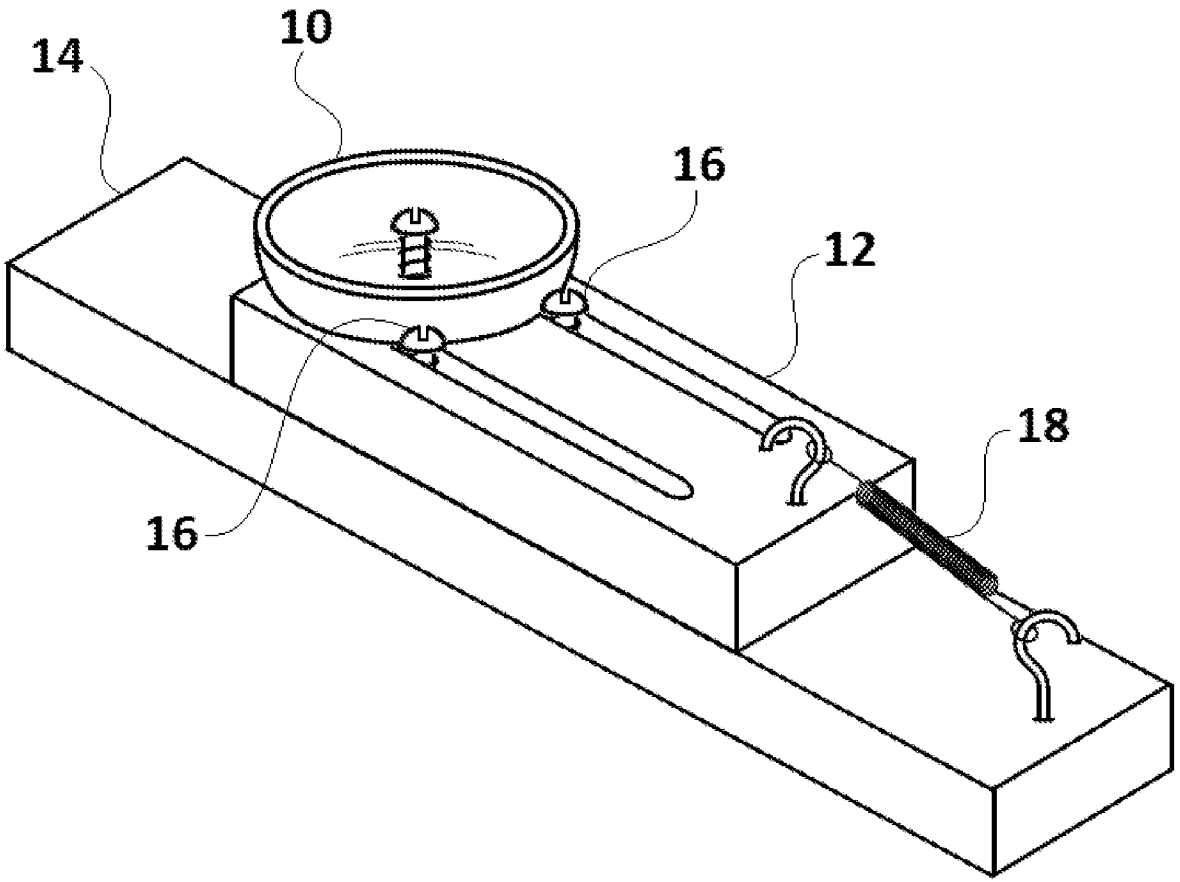
FIG. 1 is a perspective view of the device of the invention.
Figure 2:
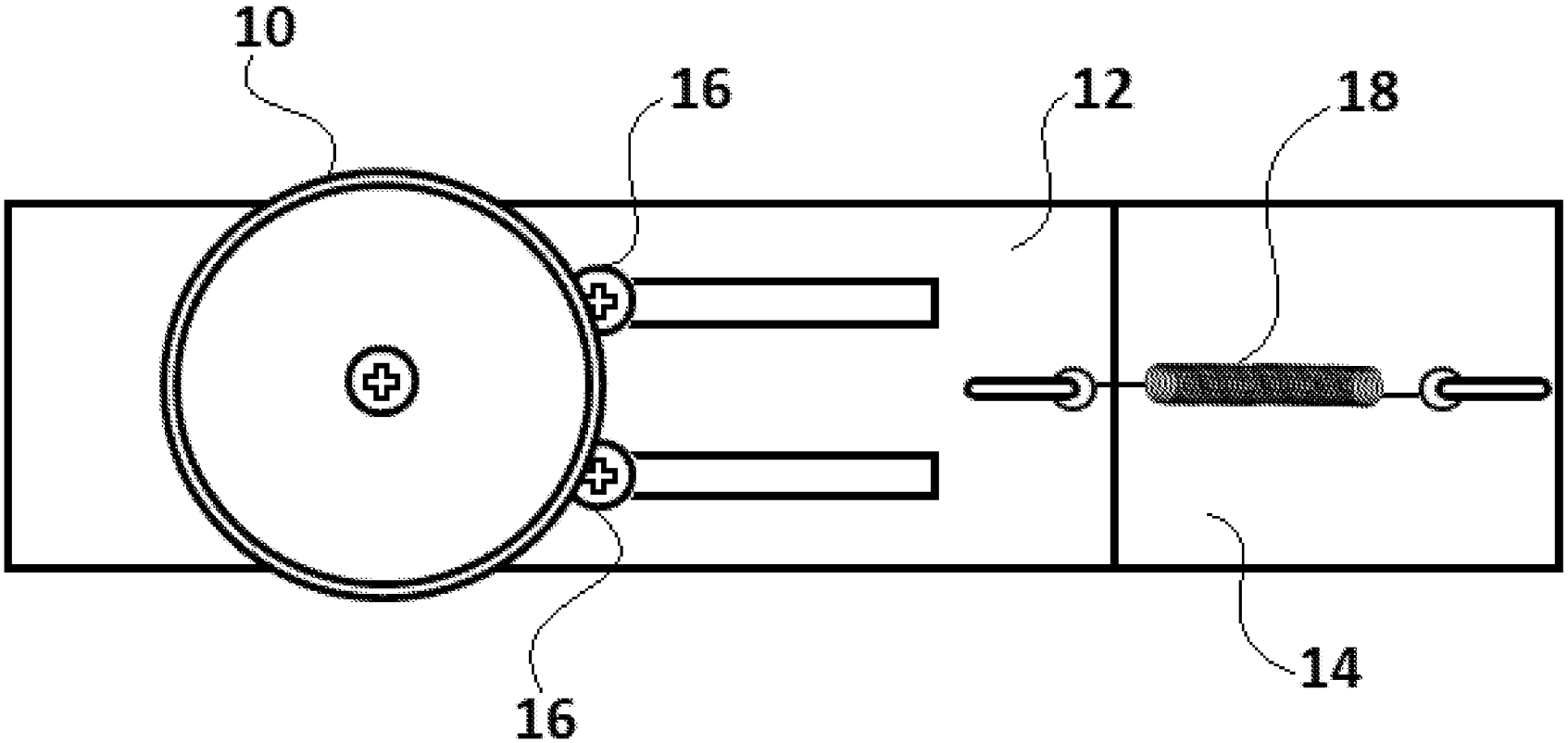
FIG. 2 is a plan view of the device.
Figure 3:
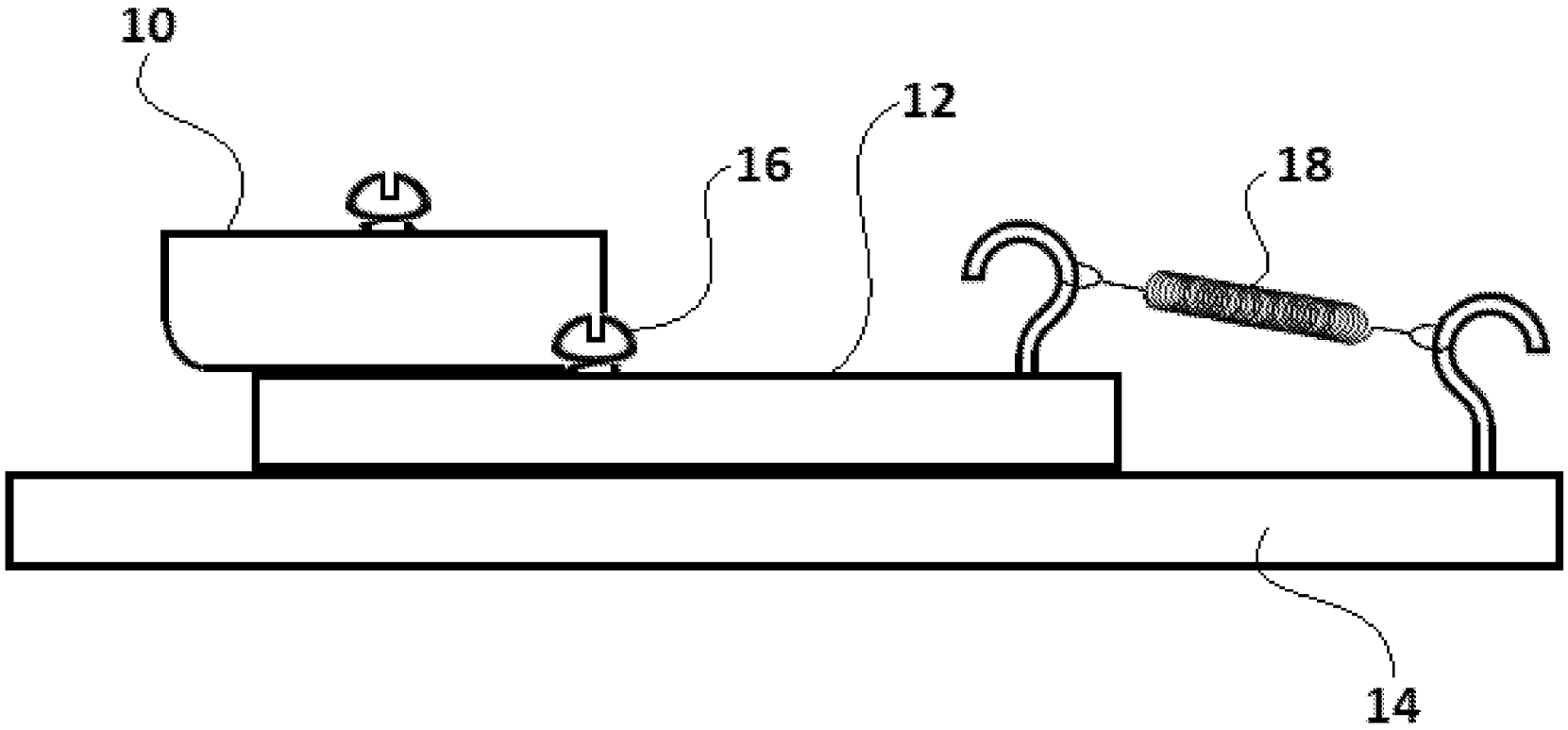
FIG. 3 is a side elevational view of the device.

FIGS. 1-3 depict a slide mechanism which can be attached to the leg of a chair, couch or bed, one device per leg, to make furniture slidable. The round leg-holder 10 is accepts in its interior the bottom of the leg of a chair, couch or bed, and then the sides of holder 10 fixes the leg in place with respect to the upper base 12.

Leg-holder 10 is fixed to the upper base 12 with the central screw shown. The upper base 12 has two longitudinal grooves and two screws 16, one in each groove, holding the upper base 12 to the lower base 14. Screws 16 are loose enough to allow upper base 12 (carrying leg-holder 10 and the attached furniture leg) to slide relative to the lower base 14.

Upper base 12 can pivot laterally about the two screws 16, to at least some degree, such that the portion of upper base 12 near spring 18 moves out to the side with respect to the lower base 14. The lateral movement of all devices attached to the legs of a single piece of furniture in the same direction allows the furniture to rotate slightly on its vertical axis. If the single piece of furniture is an office chair, the degree of lateral rotation is preferably such as to allow easier access and egress for the user when the chair is under a desk, work station or table.

Spring 18 is tensioned to assist in pulling upper base 12 (carrying leg-holder 10 and the attached furniture leg) back into the original position shown in FIGS. 1 to 3. For relaxation furniture, the spring 19 tension is strong enough to pull the furniture back with the user in place. A number of springs 14 can be used, or other elastic mechanisms can be used instead of spring 14 to effect rebound of upper base 12 when the user arises and removes their weight. For the office chair, the spring tension is less, and does not return to the original position until the user arises and lifts his/her weight off the chair. The chair is then positioned for the user to sit again (or lie down on the couch or bed) and easily slide the chair forward.

To use the device in connection with relaxation furniture, the user would rock his/her bodyweight in the direction the upper base 12 slides. In a chair or couch, the user could also push back with the feet. The spring then returns the furniture to the original position when the user relaxes, and the cycle starts over.

The lower side of lower base 14 preferably is attached to a layer of rubber or another type of supportive, cushion or sticky material, to inhibit the entire device from sliding along the floor when in position. Bearings or self-lubricating or low friction material is preferably layered between the contacting surfaces of upper base 12 and lower base 14, to assist their movement relative to each other.

The specific devices and elements described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, any of the terms "comprising", "including", containing", etc. are to be read expansively and without limitation. The methods and processes illustratively described herein suitably may be practiced in differing orders of steps, and that they are not necessarily restricted to the orders of steps indicated herein or in the claims. It is also noted that as used herein and in the appended claims, the singular forms "a," "an," and "the" include plural reference, and the plural include singular forms, unless the context clearly dictates otherwise. Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The invention has been described broadly and generically herein. Each of the narrower species and subgeneric groupings falling within the generic disclosure also form part of the invention. The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A device for attachment to furniture legs to make the furniture slidably reciprocate, comprising: a leg holder on a first support positioned above a second support having a surface, wherein the first support slides in a first direction on the surface of the second support and an elastic member affixed to the first support and the second support opposes movement of the first support in the first direction and draws the first support to a position where first support and second support most closely approach each other when no opposing force is applied to the device.

2. The device of claim 1 wherein the elastic member is a spring.

3. The device of claim 1 wherein the elastic member is affixed to an end of the first support.

4. The device of claim 1 wherein the furniture is a desk, sofa or bed.

5. The device of claim 1 wherein the leg holder is a truncated cylinder with an open side facing transverse to said first direction.

6. The device of claim 5 wherein the leg holder is fixed to the first support with a central screw.

7. The device of claim 1 wherein the first support includes two grooves aligned with the first direction and at least one screw in each of the said grooves and said screws being affixed to the second support.

8. The device of claim 7 wherein the first support can move laterally with respect to the second support.

9. A method of reciprocating furniture, comprising:

providing devices for attachment to legs of said furniture, said devices each including a leg holder on a first support positioned above a second support having a surface, wherein the first support slides in a first direction on the surface of the second support and an elastic member affixed to the first support and the second support opposes movement of the first support in the first direction and draws the first support to a position where first support and second support most closely approach each other when no opposing force is applied to the device;

applying, by a furniture user, a force in said first direction to move the furniture legs and the first supports in said first direction, and then removing the force whereby the elastic members draw the first supports and the furniture legs in a direction opposite to said first direction.

10. The method of claim 9 wherein the force may be applied by the user by pushing the furniture or by shifting body weight while positioned on the furniture.

11. The method of claim 9 wherein the elastic member is a spring.

12. The method of claim 9 wherein the elastic member is affixed to an end of the first support.

13. The method of claim 9 wherein the furniture is a desk, sofa or bed.

14. The method of claim 9 wherein the leg holder is a truncated cylinder with an open side facing transverse to said first direction.

15. The method of claim 14 wherein the leg holder is fixed to the first support with a central screw.

16. The method of claim 9 wherein the first support includes two grooves aligned with the first direction and at least one screw in each of the said grooves and said screws being affixed to the second support.

17. The method of claim 16 wherein the first support can move laterally with respect to the second support.

* * * * *